United States Patent [19]

Mardirossian

[11] 4,010,873

[45] Mar. 8, 1977

[54] TOOTHPASTE DISPENSER

[76] Inventor: Hovhannes H. Mardirossian, 42-36 81st St., Elmhurst, N.Y. 11373

[22] Filed: Aug. 18, 1975

[21] Appl. No.: 605,301

[52] U.S. Cl. ..... 222/101

[51] Int. Cl.[2] ..... B65D 35/28

[58] Field of Search ..... 222/101, 96, 103

[56] References Cited

UNITED STATES PATENTS

| | | | |
|---|---|---|---|
| 1,917,366 | 7/1933 | Gusdorf | 222/96 |
| 2,357,544 | 9/1944 | Prance | 222/96 |
| 3,326,419 | 6/1967 | Zentner | 222/101 |

*Primary Examiner*—Stanley H. Tollberg
*Assistant Examiner*—Norman L. Stack, Jr.
*Attorney, Agent, or Firm*—Daniel Jay Tick

[57] ABSTRACT

A resilient frame for accommodating a tube of amorphous material has a cover part in operative proximity with a tube of amorphous material accommodated therein. A tube compressing device in the frame is guided by the frame for compressing the tube from the end thereof to the area of the neck thereof. The tube compressing device moves the cover part in a manner whereby the cover part covers the opening of the neck of the tube when the tube compressing device is a maximum distance from the neck of the tube and the cover part frees the opening of the neck of the tube for the transfer of amorphous material when the tube compressing device is moved toward the neck of the tube.

7 Claims, 5 Drawing Figures

FIG. 3
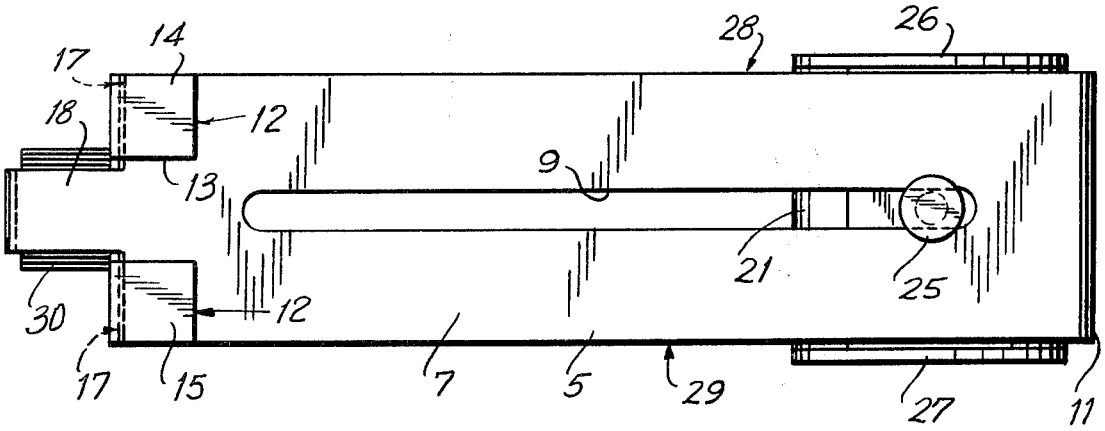
FIG. 4
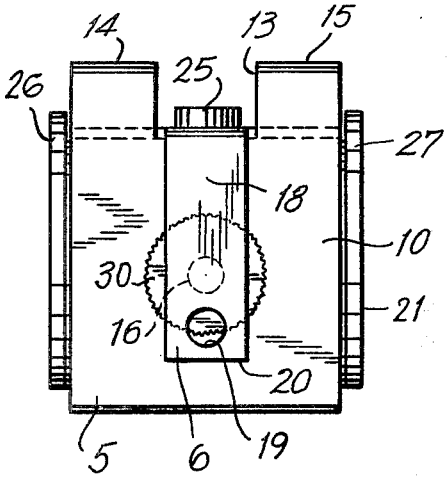
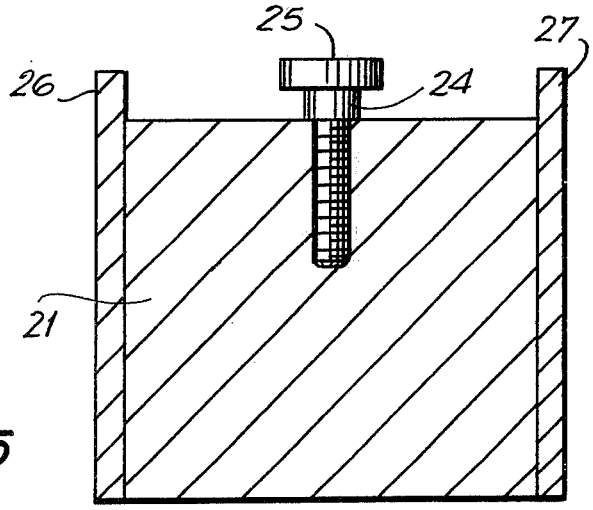
FIG. 5

TOOTHPASTE DISPENSER

BACKGROUND OF THE INVENTION

The present invention relates to a dispenser device. More particularly, the invention relates to a dispenser device for dispensing amorphous material from a tube of amorphous material such as, for example, toothpaste, or the like.

The principal object of the invention is to provide a dispenser device of simple structure for dispensing amorphous material such as, for example, toothpaste, shaving cream, concentrated hair shampoo, or the like, from a tube of such material, which device frees the opening of the tube when the material is being transferred from the tube and covers the opening of the tube when the material is not transferred from the tube.

An object of the invention is to provide a dispenser device for dispensing amorphous material such as, for example, toothpaste, shaving cream, concentrated hair shampoo, or the like, from a tube of such material with facility, convenience and rapidity, and without the waste of any material.

Another object of the invention is to provide a dispenser device for dispensing amorphous material such as, for example, toothpaste, shaving cream, concentrated hair shampoo, or the like, from a tube of such material, which device is inexpensive in manufacture and is readily mass produced.

Still another object of the invention is to provide a dispenser device, which device functions efficiently, effectively and reliably to dispense amorphous material such as, for example, toothpaste, shaving cream, concentrated hair shampoo, or the like, from a tube of such material.

BRIEF SUMMARY OF THE INVENTION

In accordance with the invention, a dispenser device for dispensing amorphous material from a tube of amorphous material has a neck, an opening in the neck and an end. The dispenser device comprises a substantially resilient frame for accommodating a tube of amorphous material. The frame comprises a unitary member of substantially parallel elongated sides maintained by spring bias at slightly less than parallel relation with each other and has a cover part in operative proximity with a tube of amorphous material accommodated in the frame. The cover part extends substantially perpendicularly from the first side of the frame. A tube compressing device in the frame is guided by the frame for compressing the tube from the end thereof to the area of the neck thereof. The tube compressing device abuts both the first and second sides of the frame in an initial position and permits the sides to remain spaced from each other due to the spring bias, and compresses the end of the tube of amorphous material between itself and the second side of the frame when moved toward the area of the neck of the tube to dispense material from the tube thereby extending the distance between the first and second sides of the frame by the thickness of the flattened tube to move the sides farther from each other whereby the cover part moves with the first side in a manner whereby the cover part covers the opening of the neck of the tube in the initial position of the tube compressing device when the tube compressing device is a substantially maximum distance from the neck of the tube. The cover part frees the opening of the neck of the tube for the transfer of amorphous material when the tube compressing device is moved toward the neck of the tube and the flattened tube is interposed between the tube compressing device and the second side of the frame.

The amorphous material comprises toothpaste.

The frame comprises a strip of substantially resilient material bent over on itself to form a substantially elongated rectangular parallelepiped frame. The frame has first and second spaced substantially parallel elongated sides. The first side has a slot extending along the length thereof. The frame has third and fourth spaced substantially parallel short sides substantially perpendicular to the elongated sides. The third side extends from the second side and has a free edge forming one end of the strip of material and having a slot formed centrally therein and extending from the free edge. The third side is bent over at right angles to itself and overlaps the first side in the area of the free edge thereof and has a hole formed therethrough for accommodating the neck of a tube of material positioned in the frame and extending between the first and second sides. The first side has a free edge forming the other opposite end of the strip of material in close proximity with the third side and has a tongue extending centrally therefrom and coplanarly therewith through the slot formed through the third side. The tongue is bent over substantially perpendicularly to itself and extends beyond the opening of the neck of the tube as the cover part in close proximity therewith. The tongue has a bore formed therethrough in the area of the free end thereof for permitting the derivation of material from the tube when the bore overlaps the opening of the neck of the tube.

The tube compressing device in the frame has a part thereof extending through the slot in the first side and is movably guided by the slot for compressing the tube from the end thereof in the area of the fourth side of the frame to the area of the neck of the tube. The cover part of the tongue in the area of the free end thereof covers the opening of the neck of the tube with the bore therethrough spaced from the opening when the tube compressing device is a substantially maximum distance from the third side. The cover part of the tongue moves with the first side of the frame so that the bore therethrough is in substantial alignment with the opening of the neck of the tube to transfer material from the tube through the bore when the tube compressing device is moved toward the third side thereby increasing the distance between the first and second sides as it moves due to the interposition of the flattened tube between the tube comprising device and the second side of the frame.

The compressing device comprises a substantially cylindrical member having a substantially pin like member extending substantially radially therefrom and through the slot through the first side of the frame and a head affixed to the pin like member to maintain the pin like member in the slot and to enable manual force to be applied to the cylindrical member via the pin like member.

The cylindrical member has a pair of base guide members of plate like configuration each extending from a corresponding base of the cylindrical member at a chordal plane formed in the cylindrical member to close proximity with a corresponding edge of the first side of the frame for maintaining movement of the cylindrical member longitudinal of the frame.

A nut like member is threadedly coupled to the neck of the tube for securing the tube in position in the frame.

BRIEF DESCRIPTION OF THE DRAWINGS

In order that the invention may be readily carried into effect, it will now be described with reference to the accompanying drawing, wherein:

FIG. 3 is a top view, taken along the lines III—III, of FIG. 2;

FIG. 4 is an end view, taken along the lines IV—IV, of FIG. 2; and

FIG. 5 is a cross-sectional view of the tube compressing device taken in a substantially vertical diametrical plane.

In the FIGS., the same components are identified by the same reference numerals.

DETAILED DESCRIPTION OF THE INVENTION

Figure 2:
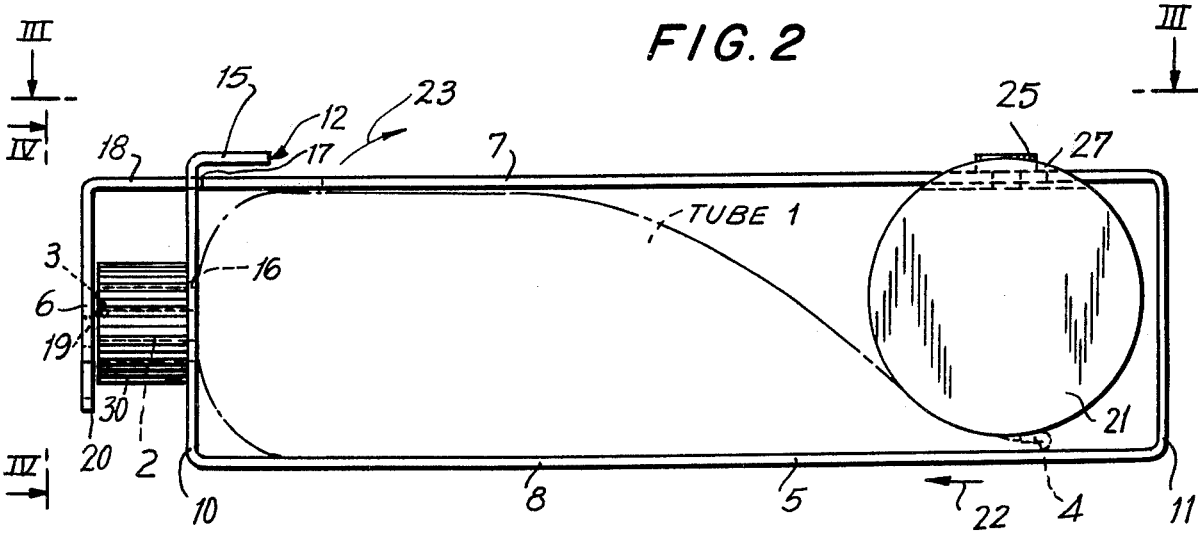
FIG. 2 is a side view of the embodiment of FIG. 1 in a dispensing position.

The dispenser device of the invention dispenses amorphous material such as, for example, toothpaste, shaving cream, concentrated hair shampoo, or the like, from a tube 1 of such material shown by broken lines in FIG. 2. The tube 1 has a neck 2 an opening 3 in the neck and an end 4, as shown in FIG. 2.

Figure 1:
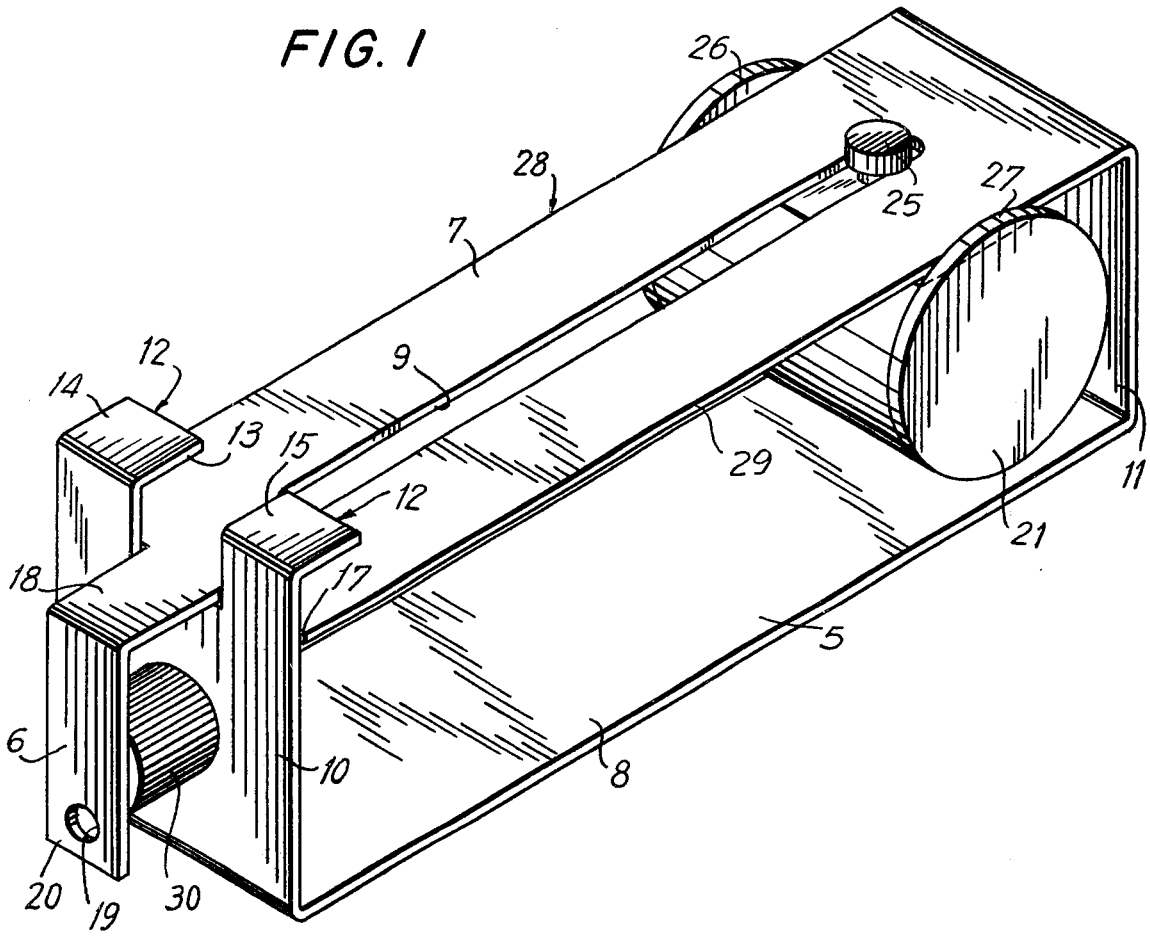
FIG. 1 is a perspective view of an embodiment of the dispenser device of the invention in its initial, non-dispensing, position.

The dispenser device of the invention comprises a substantially resilient frame 5 (FIGS. 1 to 4) for accommodating the tube 1 of amorphous material. The frame 5 comprises a unitary member of substantially resilient material having first and second spaced substantially parallel elongated sides 7 and 8 (FIGS. 1 and 2) maintained by spring bias at slightly less than parallel relation with each other, as shown in FIG. 1. The frame 5 has a cover part 6 (FIGS. 1, 2 and 4) in operative proximity with the tube 1 of amorphous material accommodated in said frame. The cover part 6 extends substantially perpendicularly from the first side of the frame 5.

The frame 5 comprises a strip of substantially resilient material such as, for example, plastic, metal, or the like, and preferably plastic, bent over on itself to form a substantially elongated rectangular parallelepiped frame, as shown in FIGS. 1 and 2. The frame 5 has first and second spaced substantially parallel elongated sides 7 and 8 (FIGS. 1 and 2). The first side 7 has a slot 9 (FIGS. 1 and 3) extending along the length thereof.

The frame 5 has third and fourth spaced substantially parallel short sides 10 and 11 substantially perpendicular to the elongated sides 7 and 8 (FIGS. 1 and 2). The third side 10 extends from the second side 8 and has a free edge 12 (FIGS. 1, 2 and 3) forming one end of the strip of material of the frame 5 and has a slot 13 (FIGS. 1, 3 and 4) formed centrally therein and extending from said free edge. The third side 10 is bent over at right angles to itself and overlaps the first side 7 in the area of the free edge 12 thereof via a pair of flaps 14 and 15 on both sides of the slot 13 (FIGS. 1 and 3). The third side 10 has a hole 16 formed therethrough (FIGS. 2 and 4) for accommodating the neck 2 of the tube 1 of material positioned in the frame 5 and extending between the first and second sides 7 and 8, as shown in FIG. 2.

The first side 7 has a free edge 17 (FIGS. 1, 2 and 3) forming the other opposite end of the strip of material in close proximity with the third side 10. The first side 7 has a tongue 18 extending centrally from the free edge 17 thereof and coplanarly therewith through the slot 13 formed through the third side 10 (FIGS. 1 to 4). The tongue 18 is bent over substantially perpendicularly to itself and extends beyond the opening of the neck 2 of the tube 1 as the cover part 6 (FIGS. 1, 2 and 4), hereinbefore described, in close proximity with said neck. The tongue 18 has a bore 19 formed therethrough in the area of the free end 20 thereof (FIGS. 1, 2 and 4) for permitting the derivation of material from the tube when the bore overlaps the opening of the neck of the tube.

A tube compressing device 21 (FIGS. 1 to 5) is provided in the frame 5 and is guided by said frame for compressing the tube 1 from the end 4 thereof to the area of the neck 2 thereof. The tube compressing device 21 abuts both the first and second sides 7 and 8 of the frame 5 in an initial position, shown in FIG. 1, and permits said sides to remain spaced from each other due to spring bias. The tube compressing device 21 compresses the end of the tube 1 of amorphous material between itself and the second side 8 of the frame 5 when moved toward the area of the neck 2 of the tube 1, as shown in FIG. 2, to dispense material from said tube thereby extending the distance between the first and second sides of the frame by the thickness of the flattened tube 1, as shown in FIG. 2, to move the sides farther from each other. The cover part 6 moves with the first side 7 of the frame 5 in a manner whereby said cover part covers the opening 3 of the neck 2 of the tube 1 in the initial position of the tube compressing device 21, shown in FIG. 1, when said tube compressing device is a substantially maximum distance from said neck, as shown in FIGS. 1, 3 and 4. The cover part 6 frees the opening 3 of the neck 2 of the tube 1 for the transfer of amorphous material when the tube compressing device 21 is moved toward said neck and the flattened tube is interposed between the tube compressing device and the second side 8 of the frame 5, as shown in FIG. 2. This is due to the fact that as the tube compressing device 21 is moved in the direction of an arrow 22 of FIG. 2 it moves the first side 7 in a clockwise direction, shown by an arrow 23 of FIG. 2, relative to the second side 8 and away from said second side.

The tube compressing device 21 in the frame 5 has a part 24 thereof extending through the slot 9 in the first side 7 (FIG. 5) and is movably guided by said slot for compressing the tube 1 from the end 4 thereof in the area of the fourth side 11 of the frame 5 to the area of the neck 2 of said tube. The cover part 6 of the tongue 18 in the area of the free end 20 thereof covers the opening 3 of the neck 2 of the tube 1 with the bore 19 therethrough spaced from the opening 3 when the tube compressing device 21 is a substantially maximum distance from the third side 10, as shown in the FIGS. The cover part 6 of the tongue 18 moves with the first side 7 of the frame 5 so that the bore 19 therethrough is in substantial alignment with the opening 3 of the neck 2 of the tube 1 to transfer material from the tube through said bore when the tube compressing device is moved toward the third side 10, in the direction of the arrow 22 of FIG. 2, thereby increasing the distance between the first and second sides 7 and 8 as it moves due to the interposition of the flattened tube between the tube compressing device and the second side of the frame, as shown in FIG. 2.

The tube compressing device 21 comprises a substantially cylindrical member having the substantially pin like member or part 24 (FIG. 5) extending substantially radially therefrom and through the slot 9 through the first side 7 of the frame 5. A head 25 (FIGS. 1 to 5) is affixed to the pin like member 24 to maintain said pin like member in the slot 9 and to enable manual force to be applied to the cylindrical member via said pin like member.

The cylindrical member has a segment removed therefrom along a chordal plane thereof, except for a border part at each base, so that the border parts form a pair of base guide members 26 and 27 (FIGS. 1, 3, 4 and 5) of plate like configuration each extending from a corresponding base of the cylindrical member at the chordal plane to close proximity with a corresponding edge 28 and 29, respectively (FIGS. 1 and 3), of the first side 7 of the frame 5 for maintaining movement of said cylindrical member longitudinal of said frame.

A nut like member 30 (FIGS. 1 to 4) is threadedly coupled to the neck 2 of the tube 1 to secure said tube in position in the frame 5.

The second side 8 of the frame 55 is preferably provided with bores (not shown in the FIGS.) to facilitate affixing the dispenser device of the invention to a supporting surface via said second side.

While the invention has been described by means of a specific example and in a specific embodiment, I do not wish to be limited thereto, for obvious modifications will occur to those skilled in the art without departing from the spirit and scope of the invention.

I claim:

1. A dispenser device for dispensing amorphous material from a tube of amorphous material having a neck, an opening in the neck and an end, said dispenser device comprising a substantially resilient frame for accommodating a tube of amorphous material said frame comprising a unitary member of substantially resilient material having first and second spaced substantially parallel elongated sides maintained by spring bias at slightly less than parallel relation with each other and having a cover part in operative proximity with a tube of amorphous material accommodated in the frame, said cover part extending substantially perpendicularly from the first side of the frame;

tube compressing means in the frame and guided by said frame for compressing the tube from the end thereof to the area of the neck thereof, said tube compressing means abutting both the first and second sides of the frame in an initial position and permitting said sides to temain spaced from each other due to said spring bias, and compressing the end of the tube of amorphous material between itself and the second side of the frame when moved toward the area of the neck of said tube to dispense material from said tube thereby extending the distance between the first and second sides of said frame by the thickness of the flattened tube to move the said sides farther from each other whereby the cover part moves with said first side in a manner whereby said cover part covers the opening of the neck of the tube in the initial position of the tube compressing means when the tube compressing means is a substantially maximum distance from the neck of the tube and said cover part frees the opening of the neck of the tube for the transfer of amorphous material when said tube compressing means is moved toward said neck of said tube and the flattened tube is interposed between the tube compressing means and said second side of said frame.

2. A dispenser device as claimed in claim 1, wherein the amorphous material comprises toothpaste.

3. A dispenser device as claimed in claim 1, wherein the frame comprises a strip of substantially resilient material bent over on itself to form a substantially elongated rectangular parallelepiped frame, said frame having first and second spaced substantially parallel elongated sides, the first side having a slot extending along the length thereof, and third and fourth spaced substantially parallel short sides substantially perpendicular to the elongated sides, the third side extending from the second side and having a free edge forming one end of the strip of material and having a slot formed centrally therein and extending from said free edge, said third side being bent over at right angles to itself and overlapping the first side in the area of the free edge thereof and having a hole formed therethrough for accommodating the neck of a tube of material positioned in the frame and extending between the first and second sides, the first side having a free edge forming the other opposite end of the strip of material in close proximity with the third side and having a tongue extending centrally therefrom and coplanarly therewith through the slot formed through the third side and being bent over substantially perpendicularly to itself and extending beyond the opening of the neck of the tube as the cover part in close proximity therewith, said tongue having a bore formed therethrough in the area of the free end thereof for permitting the derivation of material from the tube when the bore overlaps the opening of the neck of the tube.

4. A dispenser device as claimed in claim 3, wherein the tube compressing means in the frame has a part thereof extending through the slot in the first side and is movably guided by said slot for compressing the tube from the end thereof in the area of the fourth side of the frame to the area of the neck of said tube, the cover part of the tongue in the area of the free end thereof covering the opening of the neck of the tube with the bore therethrough spaced from said opening when the tube compressing means is a substantially maximum distance from the third side, and said cover part of the tongue moving with the first side of the frame so that the bore therethrough is in substantial alignment with the opening of the neck of the tube to transfer material from the tube through said bore when said tube compressing means is moved toward the third side thereby increasing the distance between the first and second sides as it moves due to the interposition of the flattened tube between the tube compressing means and the second side of the frame.

5. A dispenser device as claimed in claim 4, wherein the compressing means comprises a substantially cylindrical member having a substantially pin like member extending substantially radially therefrom and through the slot through the first side of the frame and a head affixed to the pin like member to maintain said pin like member in said slot and to enable manual force to be applied to said cylindrical member via said pin like member.

6. A dispenser device as claimed in claim 4, wherein the cylindrical member has a pair of base guide members of plate like configuration each extending from a corresponding base of the cylindrical member at a chordal plane formed in the cylindrical member to close proximity with a corresponding edge of the first side of the frame for maintaining movement of said cylindrical member longitudinal of said frame.

7. A dispenser device as claimed in claim 4, further comprising a nut like member threadedly coupled to the neck of the tube for securing the tube in position in the frame.

* * * * *